United States Patent [19]

Cobb et al.

[11] Patent Number: 4,460,294

[45] Date of Patent: Jul. 17, 1984

[54] TOGGLE TYPE TEMPORARY ROOF SUPPORT FOR MINING MACHINERY

[75] Inventors: William R. Cobb, Murrysville; Dennis J. Wehner, Baden, both of Pa.

[73] Assignee: Schroeder Brothers Corporation, McKees Rocks, Pa.

[21] Appl. No.: 327,819

[22] Filed: Dec. 7, 1981

[51] Int. Cl.[3] ..... B60P 1/48; B66F 3/00; E04G 25/00; E21D 15/44

[52] U.S. Cl. ..... 405/290; 248/357; 254/9 R; 254/124

[58] Field of Search ..... 405/288, 290; 248/357; 254/9 R, 9 B, 9 C, 124, 133 A

[56] References Cited

U.S. PATENT DOCUMENTS

| | | | |
|---|---|---|---|
| 1,594,475 | 8/1926 | Smith | 405/290 X |
| 2,764,869 | 10/1956 | Scherr | 254/9 C |
| 2,929,519 | 3/1960 | Taylor | 254/9 C |
| 3,642,250 | 2/1972 | Klopp | 254/124 |
| 3,715,101 | 2/1973 | Puhringer | 254/9 R |
| 4,252,475 | 2/1981 | Cobb et al. | 405/290 X |

FOREIGN PATENT DOCUMENTS

| | | | |
|---|---|---|---|
| 907405 | 2/1954 | Fed. Rep. of Germany | 248/357 |

*Primary Examiner*—Cornelius J. Husar
*Assistant Examiner*—Nancy J. Stodola
*Attorney, Agent, or Firm*—Webb, Burden, Robinson & Webb

[57] ABSTRACT

A temporary roof support comprising a boom pivotally mounted and positioned on the front of the mining vehicle. A temporary roof support jack is pivotally mounted to the front of said boom. The jack comprises a base structure secured to the boom and extending laterally thereof. The base structure has four pivot pins including an inside pair of pivot pins symmetrically spaced on each side of the base structure and an outside pair of pivot pins symmetrically spaced on each side of the base structure. Two pairs of swing arms are pivoted to said inside pivot pins. Two linkage extensions are pivotally joined to each other and at opposite ends to the free ends of the swing arms. Two extensible hydraulic means are pivotally secured at one end to the outside pivot pins and pivoted at the opposite ends to the swing arms such that the axes of the swing arms and extensible hydraulic means are always crossed. A beam is attached to the pivot joint of the linkage arms for supporting the roof.

4 Claims, 9 Drawing Figures

TOGGLE TYPE TEMPORARY ROOF SUPPORT FOR MINING MACHINERY

DESCRIPTION

Technical Field

This invention relates to a vehicle mounted temporary roof support for a mining vehicle of the type generally disclosed in U.S. Pat. No. 4,252,475. As pointed out therein, it is a requirement of the mine safety laws that, in most instances, temporary roof supports must be positioned before an operator can enter the space under an unbolted mine roof.

It is an advantage according to this invention to provide an improved roof jack which is carried by a boom extending forwardly of the chassis of a mining vehicle, for example, a roof bolting machine. The jack supports the roof directly from the mine floor and has a unique toggle action for enabling use in both low coal and high coal. It is a further advantage of the jack that it is rapidly extended and retracted.

A somewhat related structure, but not for the use in mining machinery, is disclosed in U.S. Pat. No. 3,642,250. A drawback of such device is explained therein; namely, mechanical means normally must be provided to move the bottom arms together. It is an advantage of this invention that mechanical linkages are not required to coordinate the movement of the toggle arms.

Disclosure of the Invention

Briefly according to this invention, a temporary roof support comprises a boom pivotally mounted and positioned on the front of a mining vehicle. The boom is mounted for rotation in a vertical plane. A temporary roof support jack is pivotally mounted to the front of the boom for positive rotational movement relative to the boom.

The temporary roof support jack comprises a base structure secured to the boom and extending laterally thereof. Generally speaking, the base structure has an elongated axis transverse to the axis of the boom and vehicle. The base structure has four pivot pins fixed thereto including an inside pair of pivot pins symmetrically spaced on each side of the location were the boom is secured to base structure and an outside pair of pivot pins also symmetrically spaced. A pair of swing arms is pivotally mounted to each inside pivot pin. The pairs of swing arms are configured and positioned to move through parallel spaced planes defining an unobstructed space therebetween. Two toggle arms are pivotally joined to each other and at opposite ends are pivotally joined to the free ends of the swing arms. The toggle arms each have a forked end defining two spaced extensions which are parallel and define an unobstructed space therebetween. The end of each toggle arm extension is pivotally mounted to one swing arm. Toggle rams (hydraulic pistons and cylinders) are pivotally secured at one end to the outside pivot pins on the base structure and at the opposite end to a pair of swing arms such that the axes of the swing arms and toggle rams are always crossed. A roof support beam is attached to the pivoted joint between the toggle arms. When the toggle rams are extended, they swing through the unobstructed space between the swing arms and the unobstructed space between the extensions to the toggle arms. Extension of the toggle rams causes the pivoted joint between the toggle arms to elevate and the forked ends of toggle arms to move together. The toggle rams are simultaneously supplied with the hydraulic fluid through a divider device which supplies an equal amount of fluid to each ram thereby resulting in substantially equal extension of the rams.

According to a preferred embodiment of this invention, the base structure supports a central box-like structure extending upwardly and terminating in a pedestal upon which the toggle arms rest when the temporary roof support jack is completely retracted. It is further preferred that a foot housing slides within the central structure. Within the foot housing in the box structure is provided a foot ram (hydraulic piston and cylinder) so that the foot housing may be actuated to move downwardly away from the base structure. It is preferred that the hydraulic fluid for actuating the foot ram be independently controllable from the hydraulic fluid for activating the toggle rams.

Brief Description of the Drawings

Further features and other objects and advantages of this invention will become clear from the detailed description made with reference to the drawings in which.

Best Mode for Carrying Out the Invention

Figure 1:
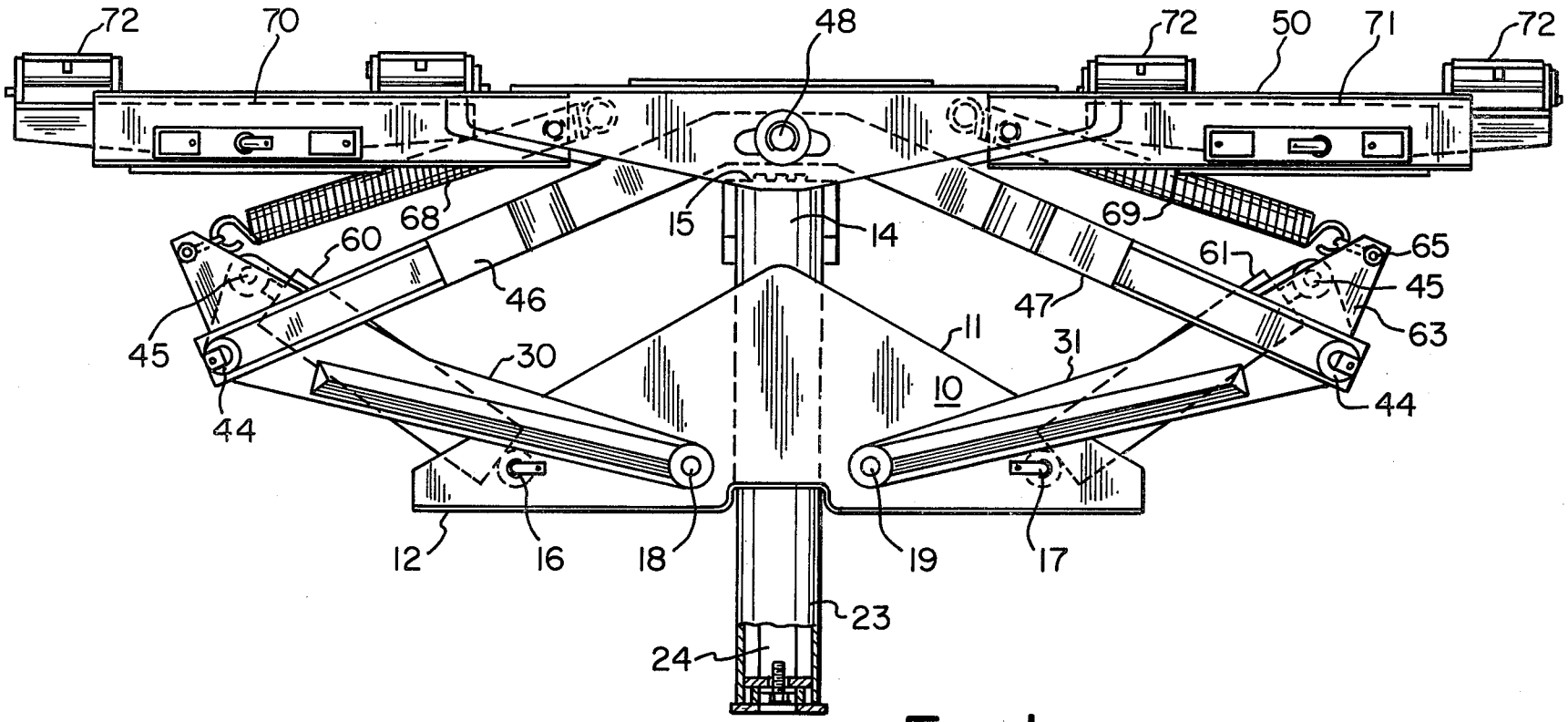
FIG. 1 is a front view of a temporary roof support jack according to this invention.

Referring now to FIG. 1, there is illustrated a temporary roof support jack according to this invention. The roof support jack comprises a base structure 10. The base structure comprises two triangular face plates 11 which, with a base plate 12 and central webs 13 define a rectangular housing therebetween. An upward extension of the housing defines a pedestal 14 that restricts the collapse of the jack as will be explained. The pedestal has a top cover 15 thereover.

Figure 2:
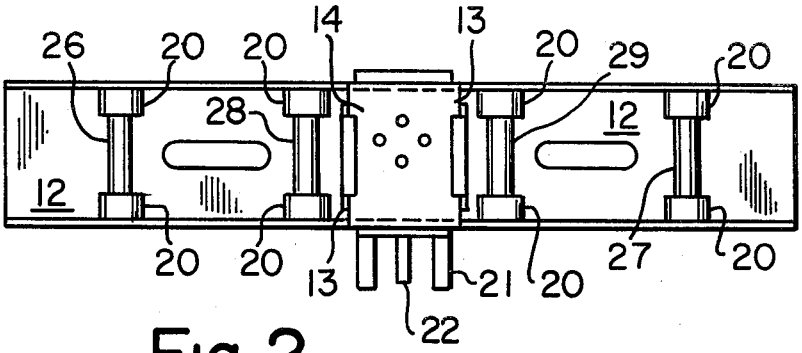
FIG. 2 is a top view of the base structure.

The face plates each have four bores 16, 17, 18, and 19 therein, two on each side, and symmetrically spaced with the outer bores 16, 17 further from the center of the base structure than the inner bores 18, 19. Associated with each bore is a cylindrical boss 20 as seen, for example, in FIG. 2. Pivot pins 26, 27, 28, 29 are journaled within the bosses. A unique toggle structure is secured from these four pivot pins.

On the back of the base structure is a set of tabs 21 having bores therein for receiving a pivot pin to hold the housing to the boom. The tabs 21 are symmetrically placed about the center of the base structure. Another tab 22 extends away from the base structure and has a bore therein for attaching a tilt ram (hydraulic piston and cylinder) to adjust the angle between the base structure and the boom. The configuration of the boom and tilt ram may be identical to that disclosed, for example, in U.S. Pat. No. 4,252,475.

Figure 3:
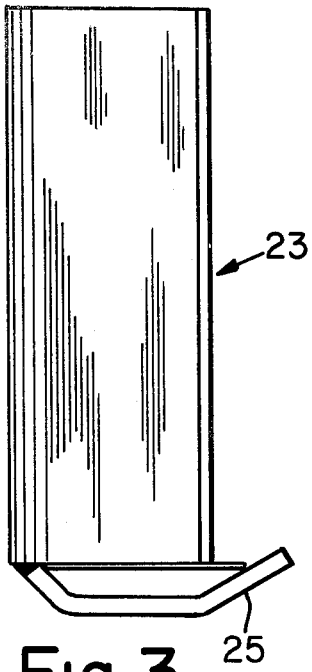
FIG. 3 is a side view of the foot assembly.
Figure 4:
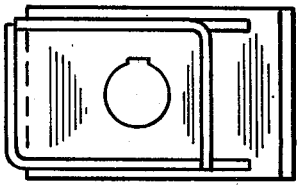
FIG. 4 is a top view of the foot assembly.

Sliding within the housing of the base structure 10 is a foot weldment 23, (see FIGS. 3 and 4). A foot ram 24 (hydraulic piston and cylinder) is positioned within the foot weldment. One end of the foot ram 24 is secured near the bottom of the foot weldment and the other end is secured to the underside of the cover 15 of the pedestal 14. Expansion of the foot ram 24 drives the foot weldment out of the housing and raises the entire base structure 10. The outer walls of the foot weldment 23 slide within the housing defined in the base structure 10. This provides stability to the structure. The very bottom of the foot weldment has a skid 25 thereon to promote sliding of the foot weldment over the surface of the mine floor when the mining vehicle is in transit and bumps in the mine floor are encountered.

Figure 5:
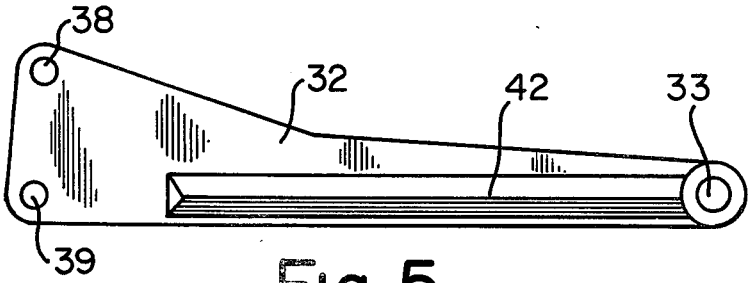
FIG. 5 is a front view of the swing arm.
Figure 6:
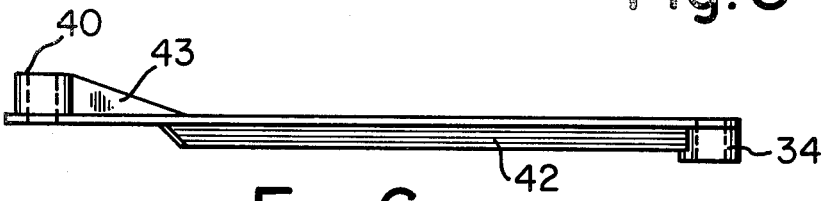
FIG. 6 is a top view of the swing arm.

Pivotally mounted to the base structure by inner pins 28, 29 are left and right swing arm pairs 30, 31. The details of the swing arms are shown in FIGS. 5 and 6. The swing arms comprise a side plate 32 defining an elongate portion with one widened end. The side plates have a single bore 33 at one end which is reinforced by a cylindrical boss 34. Near the other end of the side plates, which is the widened end, two space bores 38, 39 are reinforced by cylindrical bosses 40. Pivot pins 44, 45 are journaled in bosses 40, 41 extending between the swing arm pairs. The side plates may be stiffened by angles 42 and webs 43 welded thereto. The single bore 33 and associated boss 34 is pivotally mounted to the base structure at an inner pin (28 or 29).

Figure 7:
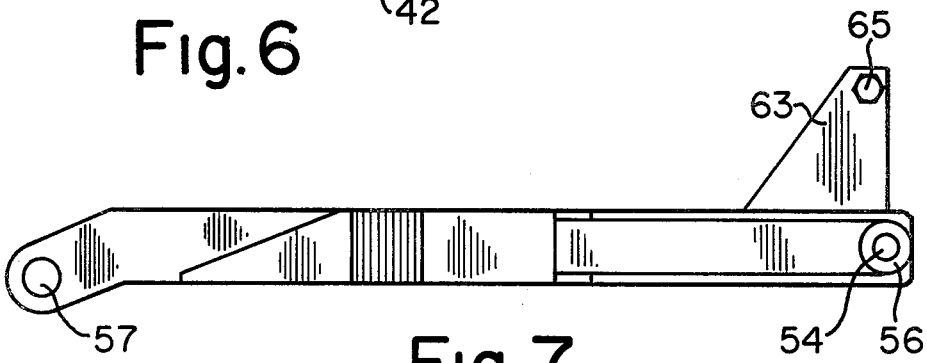
FIG. 7 is a front view of the right side of the toggle arm.
Figure 8:
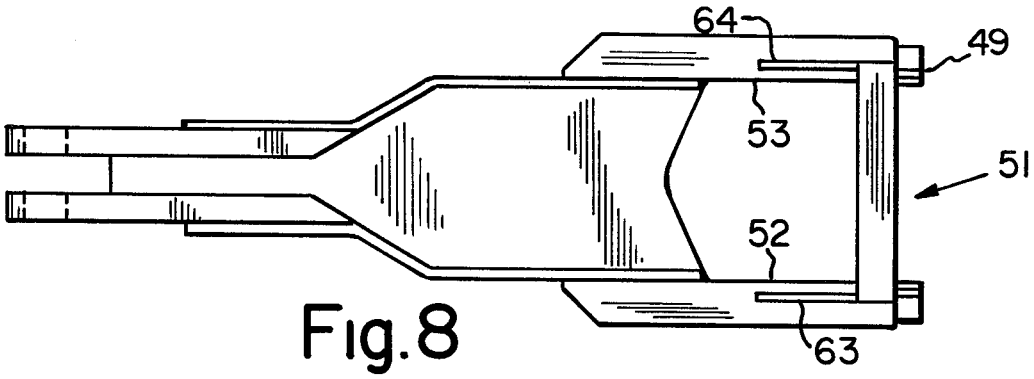
FIG. 8 is a top view of the right side toggle arm.

Left and right toggle arms 46, 47 are pivotally mounted together at one end by a pin 48 that is also pivotally secured to the roof support beam 50. Details of the toggle arms are shown in FIGS. 7 and 8. The toggle arms have a forked end 51 supporting spaced extensions 52, 53. The extremities of the spaced extensions have bores 54 reinforced by cylindrical bosses 56. The bores serve to pivotally join the extensions to the swing arm pairs at the outer and lowermost pivot pin 44, at the two bore ends of the swing arms.

The right and left toggle arms are interleaved at the ends where they are pivotally secured together. Bores 57 permit the toggle arms to be held by a pin 48. The toggle arms rest upon the top of the pedestal when fully collapsed. The ends of the toggle arms near where they are joined together may be shaped to rest solidly upon the pedestal.

Toggle rams 60, 61 are pivotally mounted at one end to the outer pins 26, 27 in the support housing the inner and uppermost pivot pin 45 extending between the swing arm pairs. Thus, as shown in FIG. 1, the axes of the swing arm pairs and toggle rams are always crossed in an "X" fashion. The unobstructed space therebetween the swing arm pairs and the extensions at the forked end of the toggle arms enables unimpeded swinging of the piston cylinder pairs.

The toggle arms have offset plates 63, 64 secured to each extension at the forked ends thereof to support a spring shackle cross pin 65. Right and left stablizing springs 68, 69 are secured at one end to a shackle pin on the toggle arm and at the other end to the beam 50 to stablize the beam during movement. If it is necessary for the support beam 50 to rotate about pin 48 to conform to the mine roof, the springs 68, 69 can be stretched. The support beam has an especially shaped opening therein through which the pin 48 passes. The opening is not simply cylindrical but is oblong with a long axis in the direction of the beam. Thus the beam is free to rotate, within limits, about a more or less vertical axis. If an end of the beam strikes the side wall of a mine entry, the shock is not transmitted to the toggle arms unless the limits of the free play are exceeded. A slow moving vehicle can be stopped almost immediately after the end of the beam strikes the wall and before the free play is exceeded. The beam may be said to float on the pin 48. Note that the oblong opening has sloped upper edges rising to a central peak. The slopes are about fifteen degrees to the axis of the beam. The combined effects of gravity, the springs, and the sloped upper edges will return the beam to a position generally perpendicular to the boom when the beam is not engaged by an obstruction such as the side wall. The beam 50 has two outer rocker beam portions 70, 71 each having two pivoted pressure plates 72 at the ends thereof.

Figure 9:
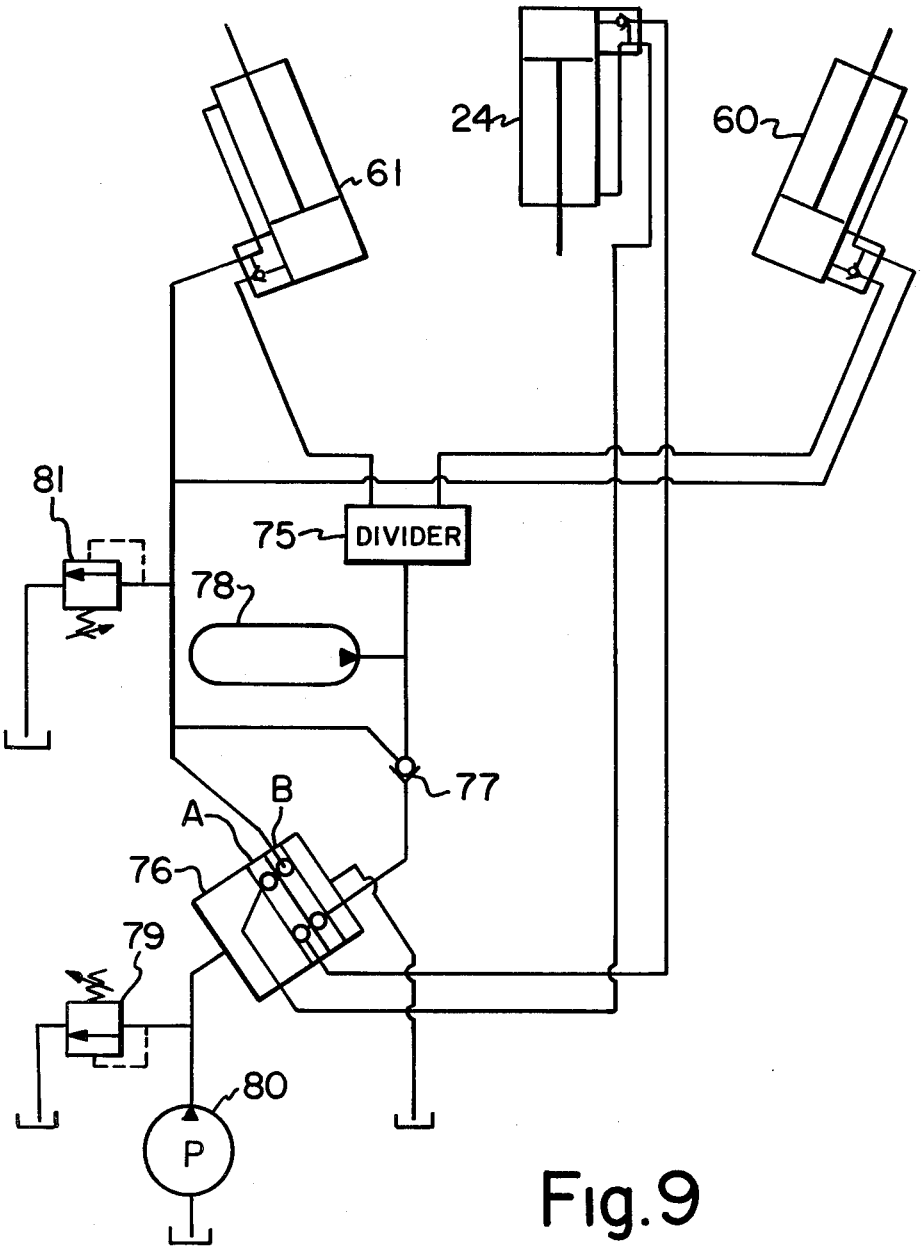
FIG. 9 is a schematic of the hydraulic system.

The hydraulic system for the temporary roof support jack is best understood from FIG. 9. The foot ram 24 is controlled by its own piping and valving. It is desirable that both the left and right toggle rams 61, 60 are simultaneously controlled and the flow to each is balanced by means of a hydraulic flow divider/combiner 75. The function of a hydraulic divider is to impose substantially uniform movement upon the two sides of the roof jack without the need for mechanical linkages to balance the rotation of the swing arms. The flow divider/combiner divides pump flow parts regardless of loads. If the standard 50/50 division is used, the flow from a single source (pump) is divided equally into two actuators. The apparatus works as a combiner in the reverse direction synchronizing return flow.

The jack is positioned by moving two valve sections A and B of a four-way valve 76. A four-way valve is a directional control valve whose primary function is to pressurize and exhaust two ports. The operation of the hydraulic system according to this invention does not depend upon any specific type of valve. Almost any four-way valve will suffice. Preferably, electrohydraulic valves are used. Controllers electrically operate pilot valves that in turn cause the main spools of the four-way valves to shift. Valve section A of valve 76 operates the foot ram 24 and valve section B operates both toggle rams 61, 60. Each cylinder has a pilot check valve associated therewith. A pilot check valve, as any check valve, permits flow in a forward direction and prevents flow under normal circumstances in the reverse direction. A pilot check valve has a control port that, if pressurized, permits flow in the reverse direction. The pilot check valves in the rams 24, 61, and 60 are required so that if hoses burst or if fittings break the jack does not collapse. When a cylinder is retracted, the pilot check valves are unseated by oil pressure at their control ports. When the toggle rams are retracted, the oil pressure also unseats the pilot check valve 77 which permits the return flow through the divider/combiner 75. The accumulator 78 also discharges at this time.

When the toggle rams 61, 60 are powered up, the accumulator 78 is charged with oil at what ever pressure was used to raise the roof beam to support the roof. The pilot check 77 keeps the accumulator from discharging once the valve 76 is returned to neutral. The accumulator's function is to maintain oil pressure in the cylinders so that the jack forced on the roof is maintained regardless of roof or floor movement.

The divider/combiner 75 is very important. The divider provides equal flow to the toggle ram 61, 60 so that the lift arms extend evenly within reason. The divider acts as a combiner as well so the toggle rams collapse together. If more oil tries to flow through one port of the divider/combiner (up or down) the increase pressure drop shifts the spools to even the flows through each circuit of the divider. There are also gear type divider/combiners. The gears mesh and must pass equal flows.

A relief valve 79 protects the pumps 80 against any malfunction downstream that causes high pressure. Relief valve 81 in the retract circuit of the toggle rams is present because with the accumulator in the expand circuit, any leakage of oil passed the cylinder pistons can cause pressure intensification on the other side. Relief valve 81 is set at some pressure higher than the relief pressure of the main relief valve 79. Intensification can also occur when the accumulator is adding cylinder make-up oil. Thus the further necessity of the pressure relief valve 81.

Operation

The operation of the boom relative to the vehicle is substantially as described in U.S. Pat. No. 4,252,475. In fact, the roof support jack described herein may be substituted for the extensible standard described therein and used with the same boom and vehicle.

When the vehicle is being trammed, the jack is normally collapsed with the foot weldment withdrawn into the support body and the toggle rams collapsed so that the support beam 50 rests upon the pedestal 14. Upon reaching the work location, the tilt ram is adjusted to bring the support body into an up-right position. Then the foot ram is extended to bring the foot into contact with the ground. Then the toggle rams are extended until the beam engages the roof. If it does not engage the roof when the toggle rams are fully extended, the foot is forced further out of the base structure until the roof is supported. For tramming short distances in high coal it is possible to simply withdraw the foot to disengage the roof.

In an actual embodiment of the aforedescribed temporary roof support jack, the distance between the bottom of the support base (with foot retracted) and the top of the beam (resting upon the pedestal) is 36 inches. The full extension of the toggle rams expands the roof support jack to 92 inches. The foot may be extended 16 inches. Thus the maximum height of a mine roof that can be supported with this actual embodiment is 108 inches.

It is preferred that the inner pins 28, 29 be closely positioned, say between 1 and 1½ feet, and the ends of the toggle arms offset toward each other somewhat such that when the toggle rams are fully extended the axes of the swing arms and toggle arms are parallel and preferably substantially aligned. In this way, the roof support jack can support the greatest load. Thus, in a high coal seam it is preferable to obtain full extension of the toggle rams before use of the foot ram.

Having thus described the invention with the detail and particularity required by the Patent Laws, what is claimed and desired protected by Letters Patent is set forth in the following claims.

1. A temporary roof support for use with mining machines comprising:

a base structure (10) having a generally vertical axis, said base structure having four pivot pins fixed thereto comprising an inside pair symmetrically spaced on each side of said axis defining inside right (19) and inside left (18) pivot pins and an outside pair of pivot pins symmetrically spaced on each side of said axis defining outside right (17) and outside left (16) pivot pins;

two pairs of swing arms defining a left swing arm pair (30) and a right swing arm pair (31), each swing arm having inner and outer ends, each swing arm having means for pivotal connection at each end, a line joining the said pivotal connection means at each end of each swing arm defining the axis of the swing arm, and said right pair of swing arms (31) being pivotally connected to said right inside pivot pin (19) at the inner end of said swing arms and said left pair of swing arms (30) being pivotally connected to said left inside pivot pin (18) at the inner end of said swing arms;

left (46) and right (47) linkage extensions having inner and outer ends, said extensions being pivotally connected (48) to each other at their inner ends and being pivotally connected at their outer ends to the outer ends of the left and right swing arm pairs respectively;

left and right extensible hydraulic means (60, 61) having inner and outer ends, each extensible means having means for pivotal connection at each end, a line joining said pivotal connection means at each end of each extensible means defining the axis of the extensible means, said right extensible means (61) being pivotally connected at its inner end to said right outside pivot pin on said base structure and connected at its outer end to the right swing arm pair such that the axes of the right extensible hydraulic means and the right swing arms are always crossed; said left extensible means (60) being pivotally connected at its inner end to said left outside pivot pin on said base structure and connected at its outer end to the right swing arm pair such that the axes of the left extensible hydraulic means and the left swing arms are always crossed; and a beam attached to the pivotal joint (48) between the left and right linkage extensions for supporting the roof.

2. The roof support according to claim 1 wherein the linkage extensions are forked at the outer end thereof.

3. The roof support according to claim 1 wherein the extensible hydraulic means are supplied hydraulic fluid through a hydraulic divider.

4. The roof support according to claim 2 wherein the right extensible hydraulic means swings in the space between the forked portion of the right linkage extension and in the space between the swing arms comprising the right pair of swing arms and likewise the left extensible hydraulic means swings in the space between the forked portion of the left linkage extension and in the space between the swing arms comprising the left pair of swing arms.

* * * * *